United States Patent [19]

Habbel et al.

[11] 4,331,078

[45] May 25, 1982

[54] INSTANTANEOUS DETONATOR WITH INSERT MEMBER WITHIN FUZE CASING

[75] Inventors: Wolfgang Habbel; Josef Prior, both of Troisdorf; Hans Schulte, Siegburg; Christoph Voges, St. Augustin, all of Fed. Rep. of Germany

[73] Assignee: Dynamit Nobel Aktiengesellschaft, Troisdorf, Fed. Rep. of Germany

[21] Appl. No.: 47,079

[22] Filed: Jun. 11, 1979

[30] Foreign Application Priority Data

Jun. 12, 1978 [DE] Fed. Rep. of Germany ..... 2825742

[51] Int. Cl.[3] ..... F42B 3/10

[52] U.S. Cl. ..... 102/202.11; 102/202.12; 102/202.14; 102/275.3

[58] Field of Search ..... 102/24 HC, 56 SC, 28 R, 102/45, 46, 280, 202.7, 202.11, 202.12, 202.14, 275.12

[56] References Cited

U.S. PATENT DOCUMENTS

| | | | |
|---|---|---|---|
| 2,024,586 | 12/1935 | Lednum | 102/28 |
| 2,986,090 | 5/1961 | Doerpinghaus | 102/28 |
| 3,088,006 | 4/1963 | Kabik et al. | 102/28 X |
| 3,175,492 | 3/1965 | Reyne | 102/28 |
| 3,557,656 | 1/1971 | Precoul | 102/24 HC |
| 3,608,492 | 9/1971 | Mitchell | 102/46 X |

FOREIGN PATENT DOCUMENTS

| | | | |
|---|---|---|---|
| 1796082 | 8/1972 | Fed. Rep. of Germany . | |
| 2257327 | 6/1973 | Fed. Rep. of Germany | 102/28 R |

*Primary Examiner*—Peter A. Nelson

*Attorney, Agent, or Firm*—Craig & Antonelli

[57] ABSTRACT

An instantaneous detonator has a detonator casing containing a primary charge and a secondary charge with fuze wires extending from outside the casing to an electrically actuated ignitor system located in the casing. An insert member is positioned in the detonator casing. This member has a continuous axial bore extending therethrough and includes a cross-sectional constriction. The bore is formed on one side of the constriction as a charge chamber that contains the primary charge and that faces the secondary charge and is formed, on the other side of the constriction, as a charge-free vacant chamber that faces the ignitor system. The insert member has a thick-wall section at least in that portion laterally surrounding the charge chamber, and the constriction has a configuration for preventing ignition of the primary charge by pressure forces exerted by air in the detonator casing compressed by detonation of an explosive acting on the exterior of the detonator casing.

8 Claims, 7 Drawing Figures

INSTANTANEOUS DETONATOR WITH INSERT MEMBER WITHIN FUZE CASING

Figure 1A:
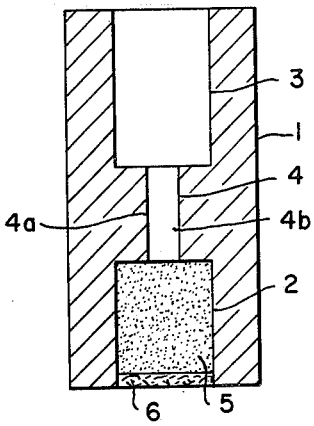

This invention relates to an instantaneous detonator having a casing containing primary and secondary charges.

Electrical instantaneous detonators comprise a fuze casing of metal or synthetic resin, sealed at one end; a bottom or secondary charge of compacted secondary explosive and a top or primary charge of initiator explosive are accommodated within this casing. The primary charge either is merely compacted or additionally covered by a perforated disk or a so-called inner cap and is thus secured against trickling out.

Tests made with these electrical instantaneous detonators showed that they are to be classified with the articles capable of exploding en masse. The capacity to explode en masse means that, in case of the explosion of a single fuze in a packaged unit with several fuzes, a chain reaction and explosion of the remaining fuzes is to be expected.

The invention is based on the problem of providing an electrical instantaneous detonator which does not explode en masse.

This problem has been solved according to this invention by an arrangement which includes an insert member positioned within the fuze casing. This member has means for preventing ignition of the primary charge due to external pressure forces acting on the top of the fuze casing. This means includes a charge chamber containing the primary charge and facing the secondary charge and a constrictive narrow bore or passage extending from the charge chamber. Preferably an open chamber which faces an electrically operated primer device and which is separated from the charge chamber by the constrictive passage is also provided in the insert member. The insert member is preferably made from metal, such as steel, aluminum, or brass but can also be made, for example, of a synthetic resin. At least the wall of the insert member laterally surrounding a charge chamber wherein the primary charge of initiator explosive is contained is thick as compared with the wall of the detonator casing. Preferably, the insert member is fashioned to be thick-walled over its entire height. The wall thickness is preferably so large that no direct initiation of the primary charge disposed in the charge chamber of the insert member takes place by an instantaneous explosion of a detonator of the same type disposed beside the detonator casing, as is the custom in packaged units. The wall thickness of the insert member is made larger, when the material forming the member has a lower strength. In case of a metallic insert member, the wall thickness of the insert member is generally about 5 to 10 times the wall thickness of a metallic detonator casing.

The insert member is inserted, with its charge chamber containing the primary charge of initiator explosive, in the detonator casing so that this chamber faces the secondary charge arranged in the lower portion of the detonator casing. Consequently, in the preferred embodiment an empty space or open chamber free of any charge faces the primer device or element of the instantaneous detonator, this primer element being disposed above the insert member at a spacing from the insert member within the detonator casing. The charge chamber and the vacant chamber of the insert member are separated from each other by a narrow cross-sectional constriction. This narrowest part of the inside cross section of a continuous axial bore extending within the insert member is, on the one hand, of such a size that the ignition jet emanating from the primer element still effects the ignition of the primary charge satisfactorily. On the other hand, however, this narrow inside cross section is so small that no ignition of the primary charge takes place by pressure forces due to the air present above the insert member in the detonator casing, once this air is compressed by a detonation effective on the detonator casing from the outside. The cross-sectional constriction is preferably fashioned as a bridging passage between the open chamber and the charge chamber in the form of a narrow central bore. The bore diameter generally will not be smaller than about 1 mm. and not larger than 3 mm.

The charge space or chamber and the empty or vacant space or chamber of the preferred embodiment of the insert member are preferably of identifical configuration, so that the insert member is symmetrical, to avoid an additional orientation of the insert member with respect to the "correct" receiving chamber during the introduction of the primary charge. The primary charge is preferably introduced so that the zone of the cross-sectional constriction is free of the intiator explosive. Optionally the cross-sectional constriction can, however, also be partially filled with primary explosive along part of the axial extension.

In the embodiment of the insert member wherein the empty or vacant chamber is omitted, the overall length of the insert member is reduced and the insert member is cut-off or terminated above the constrictive passage.

By means of the insert member of this invention with a charge chamber of large wall thickness, in which the primary charge is accommodated, a cross-sectional constriction, and preferably an additional vacant chamber, an electrical instantaneous detonator is obtained which is advantageously protected against explosions en masse.

The two fuze wires of the primer element that extend out of the detonator casing can have a length of up to several meters. The wires are preferably folded, in appropriate devices, to form figure-eight loops and are tied approximately in the centers thereof to avoid dissolution of the loops. The tying means is preferably the fuze wire proper. In case of instantaneous detonators comprising these so-called wire puppets, the provision is made according to an advantageous development of the invention, to place these detonators in an alternating arrangement, especially in the packaged units, for example, in a shipping box. By the alternating arrangement of wire puppet parts with detonator casings and those without such detonator casings, a narrow side-by-side relationship of a rather large quantity of instantaneous detonators is avoided, and thus an additional increase in safety against explosions en masse is achieved.

Figure 2:
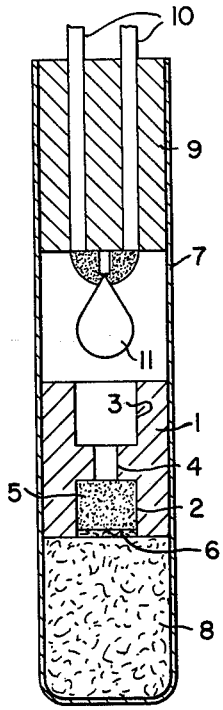
Figure 3:
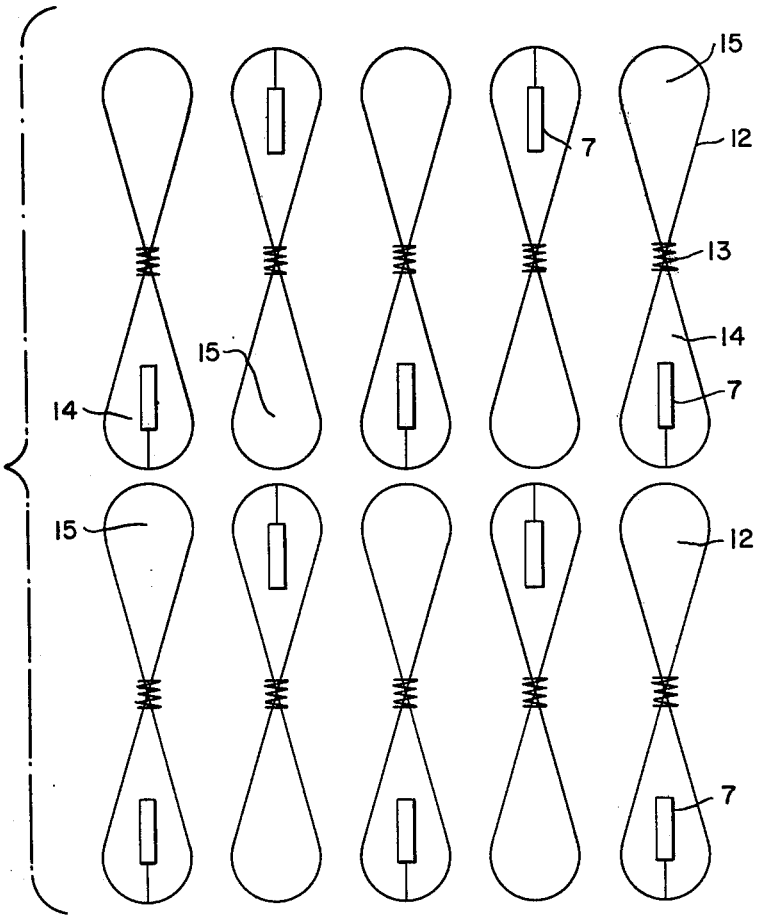

The invention is illustrated in the drawings showing embodiments thereof, and will be explained in greater detail below with reference thereto. In the drawings:

FIGS. 1*a* through 1*e* show various modifications of the insert member in a longitudinal sectional view;

FIG. 2 shows an instantaneous detonator containing an insert member of the invention in a longitudinal sectional view; and FIG. 3 shows the arrangement of several instantaneous detonators for packaging in a schematic view.

The insert member 1 made of, for example, steel shown in FIG. 1*a* is of a symmetrical configuration, i.e.

it is fashioned with an identical charge chamber 2 and vacant chamber 3. The cross-sectional constriction 4 is formed by a radial projection or bridge 4*a* with a narrow axial bore 4*b*. The primary charge 5 of initiator explosive is introduced into the charge chamber 2 and covered with a thin layer 6 of a secondary explosive, e.g. penthrite. The insert member 1 is fashioned to be thickwalled in the zone of the charge chamber 2 as well as in the zone of the vacant chamber 3, as compared with the walls of the customary detonator casings.

With an outer diameter of the insert member of about 6 mm., the inner diameter of the charge chamber 2 is generally between about 2 and 4 mm., preferably about 2.5–3.5 mm., and the bore diameter of the constriction is about 1 mm. The wall thickness of the metallic detonator casings, in this connection, is customarily between about 0.2 mm. and 0.4 mm. The axial length of the charge chamber 2 is dependent on the required amount of primary charge; this length is generally between about 4 and 6 mm.

Figure 1B:
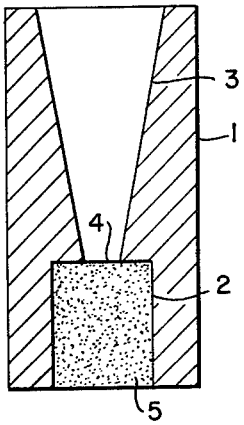
Figure 1E:
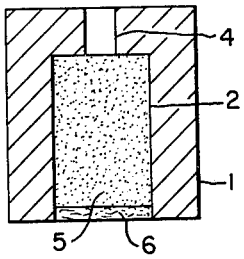
Figure 1C:
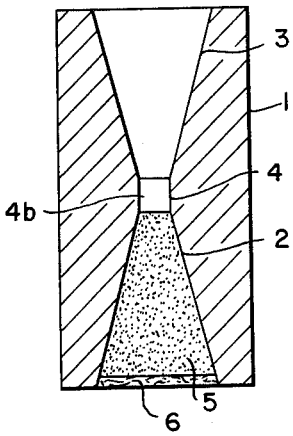
Figure 1D:
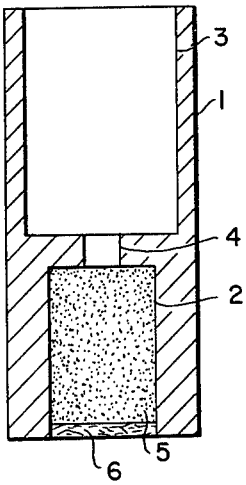

FIG. 1*b* shows an asymmetrical insert member 1 wherein the vacant chamber 3 is fashioned as a conical recess and the cross-sectional constriction 4 is limited to a linear opening. FIG. 1*c* also shows the charge chamber 2 to be conical, so that the insert member 1 with a narrow constriction 4 provided by a bore 4*b* is again symmetrical. FIG. 1*d* finally shows an insert member 1 with a configuration which is thick-walled only in the zone of the charge chamber 2 and with a vacant chamber 3 which is longer as compared with the charge chamber. FIG. 1*e* shows an insert member without an empty or vacant chamber. The diameter of the cross-sectional constriction 4 in this embodiment just as in the embodiments of the insert member with a vacant space or chamber is preferably between about 1 and 3 mm. The axial length of the constriction 4 is preferably at least equal to its diameter. In contrast thereto, in case of an insert element with an empty space, the axial length of the constriction can also be equal to zero, according to FIG. 1*b*.

The instantaneous detonator shown in FIG. 2 comprises the detonator casing 7 of, for example, aluminum, sealed at the bottom end, the secondary charge 8 being accommodated in this casing at the lower end. Preferred secondary explosives for the secondary charge for instantaneous detonators protected from explosion en masse are explosives which are of the same sensitivity, or less sensitive, against detonation shock and/or mechanical effects than tetryl. Thus, in addition to tetryl, it is possible to use, for example, also trinitrotoluene or trinitroxylene. Mounted on top of the secondary charge 8 is the insert member 1 with primary charge 5, cover 6 of penthrite, and vacant chamber 3. Suitable as the primary charge are the conventional, customary initiator explosives, such as, for example, lead azide or mixtures of lead azide with lead styphnate. At the top end, the detonator casing 7 is sealed with the plug 9 (made for example of a thermoplastic syhthetic resin such as PVC), through which the two fuze wires 10 are extended. The fuze wires are connected to the primer pellet 11 at their inner ends.

FIG. 3 shows the preferred arrangement during the packaging of the instantaneous detonators with wire puppets 12 depicted only in a schematic arrangement as figure-eight loops with a central tie 13. The detonator casings 7 are each folded over into the interior of a loop half, but could also project beyond the respective puppet end, and the puppets 12 are arranged in rows in side-by-side and superimposed relationship, for example, within a box or package, so that in each case a loop portion 14 with a detonator casing 7 and a loop portion 15 without a detonator casing are juxtaposed.

The outer diameter of usual igniter casings is between about 6 and 8 mm.; their wall thickness, as heretofore noted, is between about 0.2 to 0.4 mm. The conventional inner cap which, as heretofore described, covers the primary charge has the same small thickness, i.e. is thin-walled as compared with the thick-walled insert member according to this invention and offers no protection against bulk explosion.

By the packaging arrangement according to this invention, the spacing between the igniter casings is enlarged. Thereby the danger of bulk explosion is additionally diminished. Depending on the degree of safety required in an individual case, it may thus definitely be sufficient to utilize those igniter casings with an insert member which optionally is without a cavity or vacant space, which, in contrast to the embodiments having the vacant space, may actually explode if disposed side-by-side. However, this is not the case if these casings are arranged alternatingly in accordance with the additional provisions of this invention.

We claim:

1. An instantaneous detonator comprising a detonator casing containing a primary charge and a secondary charge and having fuze wires extending from outside the casing to an ignitor system located within walls of the casing, an insert number disposed in the detonator casing, said member having a continuous axial passage extending therethrough which includes a cross-sectional constriction means and a charge chamber that contains the primary charge and that faces the secondary charge located within said casing, said insert member having a thick-walled section at least in the portion thereof laterally surrounding the charge chamber which is thicker than adjacent walls of said casing and said constriction means preventing ignition of the primary charge by pressure forces exerted by air in the detonator casing compressed by detonation of an explosive acting on the exterior of the detonator casing.

2. The detonator of claim 1, wherein said passage includes said charge chamber at one side of said constriction means and on the other side of the constriction means a charge-free vacant chamber that faces the ignitor system.

3. The detonator of claim 1, wherein said insert member is a circular cylindrical element that is made of metal and that is symmetrical with respect to the size and shape of the charge-containing chamber and the vacant chamber.

4. The detonator of claim 2, wherein said insert member is a unitary cylindrical element of metal provided with said continuous passage extending from one end to the other end, the charge chamber and the vacant chamber being enlarged portions of the passage formed at each end of the insert element and the constriction means forms a narrow passage between said chambers.

5. The detonator of claim 4, wherein the narrow passage extends between said chambers and comprises the most narrow portion of said continuous bore.

6. An instantaneous detonator comprising a detonator casing containing a primary charge and a secondary charge and having fuze wires extending from outside the casing to an ignitor system located in the casing, a unitary cylindrical element of metal disposed in the detonator casing; said element having a continuous axial passage extending therethrough which includes a charge chamber that contains the primary charge and that faces the secondary charge, a cross-sectional constriction means, and a charge-free vacant chamber that faces the igniter system, said charge chamber and vacant chamber being enlarged portions of the passage formed at each end of the cylindrical element and the constriction means forming a narrow passage between said chambers, at least one of the chambers being in the form of a conical-shaped bore cavity and said cylindrical element having a thick-walled section at least in the portion thereof laterally surrounding the charge chamber and said constriction means preventing ignition of the primary charge by pressure forces exerted by air in the detonator casing compressed by detonation of an explosive acting on the exterior of the detonator casing.

7. The detonator of claim 1, wherein said insert member is formed of metal or a synthetic resin.

8. The detonator of claim 1, wherein said passage includes said charge chamber at one side of said constriction means and on the other side of the constriction means a charge-free vacant chamber that faces the igniter system, and said insert member is a unitary cylindrical element of metal or synthetic resin.

* * * * *